United States Patent [19]

Fuchs, Jr.

[11] Patent Number: 4,523,444

[45] Date of Patent: Jun. 18, 1985

[54] METHODS OF AND APPARATUS FOR CONTROLLING THE GAP BETWEEN A MANDREL AND DIE DURING EXTRUSION

[76] Inventor: Francis J. Fuchs, Jr., 593 104th Ave., Naples, Fla. 33940

[21] Appl. No.: 449,561

[22] Filed: Dec. 13, 1982

[51] Int. Cl.[3] ..... B21C 31/00; B21C 33/00; B21C 51/00

[52] U.S. Cl. ..... 72/21; 72/264; 72/262

[58] Field of Search ..... 72/21–23, 72/260, 262, 264, 265, 283, 285, 273.5; 264/40.1, 40.5, 40.7; 425/376 R, 381, 461, 466

[56] References Cited

U.S. PATENT DOCUMENTS

| | | | |
|---|---|---|---|
| 3,422,648 | 1/1969 | Lemelson | 72/265 |
| 3,468,152 | 9/1969 | Croseck et al. | 72/265 |
| 3,546,908 | 12/1970 | Russell | 72/21 |
| 3,570,288 | 3/1971 | Fischer et al. | 72/21 |
| 3,709,013 | 1/1973 | Petsch | 72/265 |
| 3,950,979 | 4/1976 | Fuchs, Jr. | 72/265 |
| 4,044,580 | 8/1977 | Worden et al. | 72/21 |
| 4,420,958 | 12/1983 | Schulz et al. | 72/21 |

*Primary Examiner*—Lowell A. Larson
*Attorney, Agent, or Firm*—R. Gale Rhodes, Jr.

[57] ABSTRACT

Methods of and apparatus for controlling the gap between a mandrel and an extrusion die during extrusion wherein upon the actual gap between the mandrel and die during extrusion being detected as being larger than a predetermined gap, relative movement between the mandrel and die is produced to close the actual gap and establish the predetermined gap, and upon the actual gap between the mandrel and die during extrusion being detected as being smaller than the predetermined gap, relative movement between the mandrel and die is produced to open the actual gap and establish the predetermined gap.

8 Claims, 3 Drawing Figures

METHODS OF AND APPARATUS FOR CONTROLLING THE GAP BETWEEN A MANDREL AND DIE DURING EXTRUSION

BACKGROUND OF THE INVENTION

This invention relates generally to methods of and apparatus for controlling the gap between the mandrel and die during extrusion, and in particular relates to methods of and apparatus for controlling the gap between a mandrel and die during the continuous extrusion of tubing from a larger to smaller diameter.

As known to those skilled in the extrusion art, especially those skilled in the art of continuously extruding large diameter tubing into smaller diameter tubing, for the extrusion of uniform product at a minimum pressure with good speed control, the gap between the mandrel and die must remain constant. As is further known to those skilled in the extrusion art, the extrusion process sets up dynamic forces which act on the mandrel and die causing the actual gap therebetween to be larger and smaller than the desired constant gap at different times thereby causing large variation in extrusion pressure.

More particularly, and as is known to those skilled in the art, upon the commencement of the extrusion process with the extrusion pressure going from zero to maximum, the mandrel and die compress thereby causing the actual gap therebetween to be larger than the desired gap whereby the material being extruded therebetween work hardens producing redundant work which makes the material less deformable and causes the extrusion pressure to rise producing extrusion control problems; extrusion conditions can arise causing the actual gap between the mandrel and die to be smaller than the desired gap, such as for example upon the commencement of extrusion with the product initially flowing over the mandrel, friction drag forces are produced on the mandrel causing it to move toward the die making the actual gap therebetween smaller than the desired gap and effectively creating a "check valve" between the mandrel and die causing the extrusion pressure to rise exponentially thereby again causing extrusion control problems.

Gap control apparatus and methods are known to the prior art, for example those disclosed in U.S. Pat. No. 3,950,979 issued Apr. 20, 1976 to F. J. Fuchs, Jr.; however, the invention disclosed therein is for controlling the die gap upon the actual gap being larger than the desired gap and includes no teaching of how to control the actual gap upon the actual gap becoming smaller than the desired gap.

Accordingly, there exists a need in such extrusion art for methods of and apparatus for controlling the actual gap between the mandrel and die during extrusion and for re-establishing the desired gap upon the actual gap becoming larger or smaller than the desired gap.

As is still further known to those skilled in the art, in the typical extrusion operation particularly a continuous extrusion operation, the die is typically of relatively short length but is supported by a die stem of considerably larger length and it is the die stem which experiences the above-noted compression causing the gap control problems. Still further, as is also known to those skilled in the art, the mandrel is typically of considerable length and the above-noted compression occurs over the length of the entire mandrel. Accordingly, it has been found to be highly desirable, if not required, that the apparatus for sensing the actual gap between the mandrel and die be positioned as close as reasonably possible to the actual gap or the area sometimes referred to in the art as the zone of deformation.

Accordingly, it is a further object of the present invention to provide methods of and apparatus for controlling the gap between a mandrel and die whereby the sensing of the actual gap is performed in close proximity to the actual gap or the zone of deformation.

SUMMARY OF THE INVENTION

The methods and apparatus of the present invention satisfy the above-mentioned gap control need and objects of the invention by causing relative movement between the mandrel and die during extrusion upon the actual gap therebetween being detected as being larger or smaller than the desired gap which relative movement reestablishes the desired gap. This relative movement, in the preferred embodiment of the invention, is caused by a servo mechanism operatively interconnected to at least one of the mandrel and die, or both, and which servo mechanism upon the actual gap becoming larger than the desired gap, causes relative movement between the mandrel and die to close the gap and establish the desired gap, and upon the actual gap between the mandrel and die becoming smaller than the desired gap causes relative movement between the mandrel and die to open the gap and establish the desired gap. The detecting of the actual gap between the mandrel and die is performed at points in close proximity to the actual gap thereby obviating inaccuracies caused by elastic movement of the mandrel and die or die stem due to compression and/or elongatation thereof caused by the extrusion process.

DESCRIPTION OF THE PREFERRED EMBODIMENT

Figure 1:
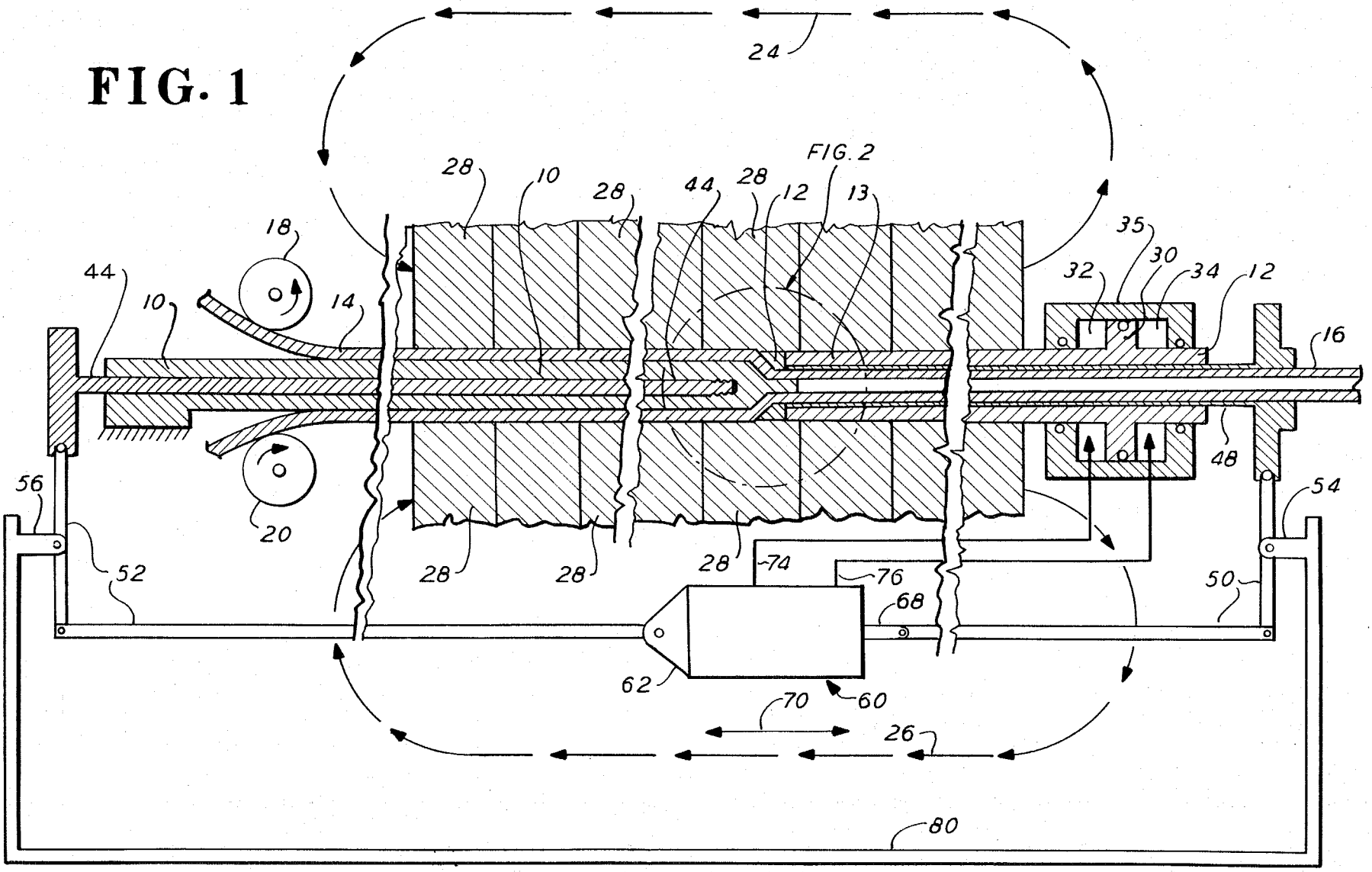
FIG. 1 is a diagrammatic illustration of apparatus embodying the present invention and illustrating the method of the present invention, the apparatus being shown in cross-section.
Figure 2:
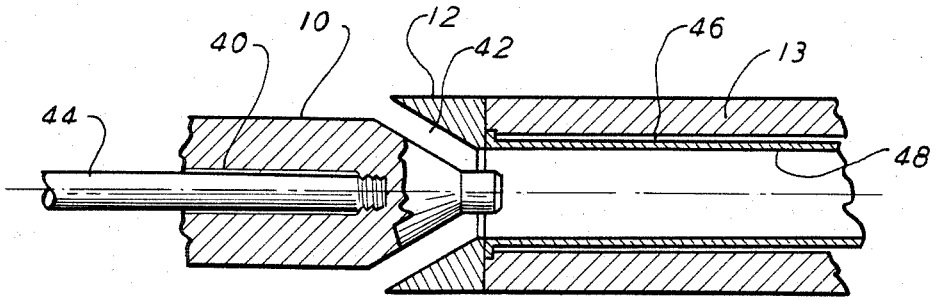
FIG. 2 is an enlarged view of the apparatus within circle 2 of FIG. 1.

Referring to FIG. 1, there are illustrated, diagrammatically, methods and apparatus according to the present invention for controlling the gap between the mandrel 10 and a die 12 during extrusion, in particular as illustrated in FIG. 1, during a continuous operation wherein tubing 14 of a larger diameter is continuously extruded into tubing 16 of a smaller diameter; the tubing 14 of larger diameter may be continuously formed into tubing around the mandrel 10 in the manner known to those skilled in the art from sheet or strip material by suitable tube forming apparatus, illustrated diagrammatically by rollers 18 and 20, and subsequently welded into continuous tubing by suitable welding apparatus not shown, such tube forming and welding apparatus each may be one of several known to those skilled in the tube forming art. Die 12, as shown in FIGS. 1 and 2, is a tapered generally circular die and may be suitably secured to and supported by a die stem 13 in the manner known to those skilled in the extrusion art or the die 12 and die stem 13 may be unitary apparatus; accordingly as used hereinafter in the specification and the appended claims, the term "die" will be used to define both such structures unless specifically stated otherwise.

The continuous extrusion apparatus illustrated diagrammatically in FIG. 1 by elliptical loops of arrows 24 and 26 and by groups or trains of gripping element quadrants 28 partially shown in cross-section, may be, for example, illustrative of the continuous extrusion apparatus disclosed in U.S. Pat. No. 3,740,985, issued June 26, 1973 in the name of Francis J. Fuchs, Jr. as inventor; however, it will be understood by those skilled in the art that the present invention is not limited to use with such continuous extrusion apparatus and may be used beneficially with other extrusion apparatus. As may be understood in greater detail from reference to the afore-noted U.S. patent, four trains of gripping element quadrants (e.g. 28) are moved continuously around endless paths, indicated by elliptical loops of arrows 24 and 26, in the direction of travel indicated by the arrows and are placed in continuous operative engagement with the elongated surface of the tubing of larger diameter 14 to continuously apply motive force along the surface of the tubing 14 in the direction of the die 12 to continuously advance the tubing of larger diameter 14 into and through the die 12 to continuously extrude the tubing of larger diameter 14 into the tubing of smaller diameter 16.

In the gap control method and apparatus of the preferred embodiment of the present invention, as illustrated in FIG. 1, the die 12, or die stem 13, if provided, is mounted as a double acting piston 30 between forward and rearward pressurized fluid chambers 32 and 34 provided in a cylinder or pressure vessel 35. As is further illustrated in FIG. 1, but as may be better seen in detail from FIG. 2, the mandrel 10 is provided with a centrally formed bore 40 extending from the rear of the mandrel toward the front of the mandrel to a point in close proximity to the gap 42, a generally annular gap, between the mandrel 10 and the die 12. Positioned in the bore 40 is a sensing rod 44 for relative movement with respect to the mandrel and with the front end of the sensing rod 40 connected to the front end of the mandrel in close proximity to the gap 42 and with the rear end of the rod 44 (FIG. 1) connected to mechanical linkage 52 mounted pivotally at pivot point 56. The die 12, as illustrated in detail in FIG. 2, in the preferred embodiment of the present invention, is provided with a cylindrical die stem 13 with the I.D. of the die stem being larger than the I.D. of the rearward portion of the annular extrusion die 12 thereby providing a generally longitudinally extending annular space 46 for receiving a sensing cylinder 48 positioned therein for the relative movement with respect to the die stem and with the front end of the sensing cylinder being preferably flanged as shown and connected to the rearward portion of the extrusion die 12 at a point in close proximity to the gap 42; the rear of the sensing cylinder 48, as shown in FIG. 1, is connected to mechanical linkage 50 mounted pivotally at pivot point 54.

Figure 3:
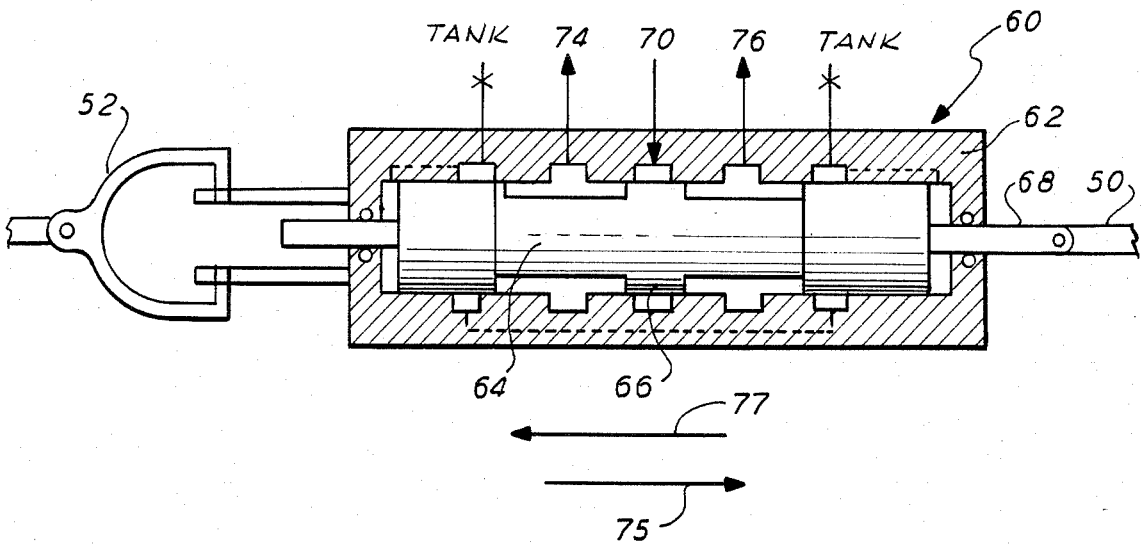
FIG. 3 is a diagrammatic illustration in cross-section of a servo mechanism, namely a pressurized fluid servo valve, which may be used advantageously in the practice of the present invention.

The mechanical linkages 52 and 50, and hence the sensing rod 44 and sensing cylinder 48, are operatively interconnected with a servo mechanism indicated by general numerical designation 60 in FIG. 1 and shown in detail in FIG. 3. Referring to FIG. 3, the servo mechanism may comprise a pressurized fluid servo valve including a cylinder or pressure vessel 62, an internal valve spool 64 having a single central ridge 66, and a stem 68 connected to the rightward end of the valve spool 64 and exiting the rightward end of the pressure vessel 62. The servo mechanism 60 may be provided with a pressurized fluid inlet port 70 for connection to a suitable source of pressurized fluid not shown, first and second pressurized fluid outlet ports 74 and 76 for suitable interconnection, respectively, as shown in FIG. 1 to the forward and rearward pressurized fluid chambers 32 and 34 of the pressure vessel 35. The servo mechanism 60 may be further provided with suitable pressurized fluid outlet ports identified as Tank, as shown in FIG. 3, for exhaustion of pressurized fluid to a suitable tank not shown; additionally, in the manner known to those skilled in the art, and as indicated in dashed line in FIG. 3, the space at the ends of the valve spool 64 may be suitably vented to the tank as shown. As shown in FIG. 1, the valve spool stem 68 is connected to the mechanical linkage 50 and hence to the sensing cylinder 48, and the leftward portion of the pressure vessel 62 of the servo mechanism 60 is connected to the mechanical linkage 52 and hence to the rear of the sensing rod 44. It will be understood, and as illustrated in FIG. 1, that the mechanical linkages 52 and 50 support the servo mechanism 60 for free reciprocating movement in the directions indicated by the double headed arrow 70 in FIG. 1.

To prevent the pivot points 56 and 54 for the mechanical linkages 52 and 50 from being subject to stress caused by the extrusion of the tubing and thereby being subject to relative movement, the two pivot points may be preferably supported independently of this extrusion apparatus by rigid structure not subject to such stress, such as for example the mounting structure for the extrusion apparatus, with such rigid structure being illustrated diagrammatically by the rigid member 80 shown in FIG. 1. By being supported independently of the extrusion apparatus, the two pivot points 56 and 54 remain fixed relative to each other during the extrusion process and not subject to stress associated with the extrusion process.

As noted above, for control of the extrusion process and the extrusion of uniform product such as tubing, the gap 42 between the mandrel 10 and die 12 must remain constant or of a predetermined gap during extrusion and in the preferred embodiment of the present invention illustrated, upon the presence of the desired or predetermined gap, the central ridge 66 of the valve spool 64 (FIG. 3) is positioned centrally within the pressure vessel 62 whereby the central ridge 66 closes the pressurized fluid inlet port 70 and prohibits pressurized fluid from being admitted through the pressurized fluid outlet ports 74 and 76 to either the forward or rearward chambers 32 and 34 of the double acting piston 30 of FIG. 1 and hence, a condition of equilibrium is established in the servo mechanism which is maintained as long as the gap 42 between the mandrel 10 and die 20 is constant or of the predetermined gap. Upon the actual gap between the mandrel 10 and die 12 being larger than the desired or predetermined gap, relative movement will have occurred between the mandrel and die causing them to separate as viewed in FIG. 1 which relative movement will be caused by either the die moving away from the mandrel or by the mandrel moving away from the die or by both. Such relative movement will be sensed by the sensing rod 44 and the sensing cylinder 48 causing them to separate as viewed in FIG. 1 and this relative movement will be correspondingly transmitted through the mechanical linkages 52 and 50 to the pressure vessel 62 of the servo mechanism and the valve spool stem 68 causing relative movement therebetween which will cause the valve spool 64 to move leftwardly as indicated by the arrow 77 in FIG. 3 relative to the pressure vessel 62 thereby causing the central ridge 66 to uncover the pressurized fluid inlet port 70 and place it in fluid communication with the pressurized outlet port 76 causing pressurized fluid to be admitted to the rearward pressure chamber 34 (FIG. 1) of the pressure vessel 35 to produce force acting on the double acting cylinder 30 to move the die 12 leftwardly as viewed in FIG. 1 toward the mandrel 10 producing relative movement therebetween to close the actual gap and reestablish the desired or predetermined gaps and this relative movement will also be sensed by the sensing rod 44 and sensing cylinder 48 causing them to produce relative movement between the pressure vessel 62 and the valve spool stem 68 to move the valve spool 64 rightwardly in the direction of the arrow 75 in FIG. 3 relative to the pressure vessel 62 to again cause the central ridge to cover the pressurized fluid inlet port 70 and discontinue admission of pressurized fluid to the rearward pressurized fluid chamber 34 of the double acting piston 30 thereby reestablishing the condition of equilibrium in the servo mechanism 60.

Accordingly, it will be understood that the presence of an actual gap between the mandrel 10 and die 12 larger than the desired or predetermined gap sets up a condition of disequilibrium within the servo mechanism 60 which causes relative movement between the mandrel and die to close the actual gap and reestablish the desired or predetermined gap.

Alternatively, upon the actual gap between the mandrel 10 and die 12 being smaller than the desired or predetermined gap, relative movement will have occurred between the mandrel and die causing them to move toward each other as viewed in FIG. 1 which relative movement can be caused by the mandrel moving toward the die or the die moving toward the mandrel or both. This relative movement will be sensed by the sensing rod 44 and the sensing cylinder 48 producing relative movement therebetween causing them to move toward each other as viewed in FIG. 1 and this relative movement will be correspondingly transmitted through the mechanical linkages 52 and 50 to the pressure vessel 62 and the valve spool stem 68 causing relative movement therebetween which will move the valve spool 64 rightwardly as indicated by the arrow 75 in FIG. 3 relative to the pressure vessel 62 thereby causing the central ridge 66 to uncover the pressurized inlet port 70 thereby communicating the pressurized fluid through the pressurized fluid outlet port 74 to the forward pressurized fluid chamber 32 (FIG. 1) of the doubleacting piston 30 thereby producing force acting on the piston 30 to move the piston and the die rightwardly as viewed in FIG. 1 thereby producing relative movement between the mandrel and die which will be sensed by the sensing rod 44 and the sensing cylinder 48 to produce relative movement through the mechanical linkages 52 and 50 between the pressure vessel 62 and the valve spool stem 68 causing the valve spool 64 to move leftward relative to the pressure vessel 62 thereby causing the central ridge 66 to again cover the pressurized fluid inlet port 70 to cease admission of pressurized fluid to the rearward pressurized chamber 32 of the double acting piston 30 thereby reestablishing the condition of equilibrium. Accordingly, it will be understood that the presence of an actual gap between the mandrel and die smaller than the desired or predetermined gap sets up a second condition of dis-equilibrium within the servo mechanism 60 which causes the relative movement between the mandrel and the die to open the actual gap and reestablish the desired or predetermined gap.

It will be understood by those skilled in the art that the condition of the die and mandrel simultaneously moving toward each other or simultaneously moving away from each other is more critical than the condition of just either moving away from the other. Such simultaneous movement is sensed immediately by the above described control apparatus of the present invention and relative movement between the pressure vessel 62 of the servo mechanism 60 and the valve spool stem 68 is increased beyond that which is produced upon just either the mandrel or die moving toward or away from each other and hence the response or reaction time of the control apparatus of the present invention is expedited beyond that which is provided by only either the mandrel or die moving toward or away from each other. This expedited response or reaction time provides unique and improved gap control beyond that provided by gap control apparatus known to the prior art.

It will be further understood by those skilled in the art that in accordance with the teachings of the present invention, the mandrel 10, instead of the die 12, may be mounted as a double acting piston.

It will be further understood by those skilled in the art that the detection and sensing of the actual gap between the mandrel 10 and die 12 is performed in accordance with the apparatus and method of the present invention in close proximity to the actual gap thereby obviating inaccuracies which can be caused by elastic movement of the mandrel and die or die stem due to compression and/or elongation thereof caused by stress produced by the extrusion process. The term "close proximity" will be understood to mean that the forward end of sensing rod 44 is placed as close to the forward end of the mandrel 10 as possible and the forward end of the sensing cylinder 48 is placed as close to the extrusion die 12 as possible, given existing conditions, such as for example the strength of the material of the components, the length of the mandrel, die, sensing rod and sensing cylinder, and other technical considerations known to those skilled in the art.

Instead of the servo mechanism disclosed in the preferred embodiment of the present invention, it will be understood that such pressurized fluid servo mechanism can be replaced by known electrical or electronic equivalents such as, for example, the microprocessor, potentiometer, and other mechanisms known to the art as being equivalents of the disclosed servo mechanism; such alternate structure is within the contemplation of the present invention.

Many variations and modifications may be made in the present invention without departing from the spirit and the scope thereof.

Referring again to FIG. 1, it will be understood that upon pressurized fluid being admitted through pressurized fluid outlet port 76 to the rearward pressure chamber 34 of the double acting piston 30, the forward pressurized fluid chamber 32 will be exhausted through pressurized fluid outlet port 74 to the Tank, and upon the pressurized fluid being admitted through the pressurized fluid outlet port 74 to the rearward pressurized fluid chamber 32 of double acting piston 30, the forward pressurized fluid chamber 34 will be exhausted to the Tank through the pressurized fluid outlet port 76.

What is claimed is:

1. Apparatus for controlling the gap between a mandrel and an extrusion die during extrusion of product, comprising:

control means for detecting that the actual gap between the mandrel and die during extrusion is larger than a predetermined gap and for causing relative movement between the mandrel and die to close the actual gap and establish the predetermined gap, and for detecting that the actual gap between the mandrel and die during extrusion is smaller than the predetermined gap and for causing relative movement between the mandrel and die to open the actual gap and establish the predetermined gap.

2. Apparatus according to claim 1 wherein the control means comprise first and second sensing means connected, respectively, to the mandrel and die in close proximity to the gap therebetween and wherein the control means further comprise a servo mechanism operatively interconnecting the first and second sensing means.

3. Apparatus according to claim 2 wherein the control means further comprise first and second mechanical linkages, respectively, interconnecting the first and second sensing means with the servo mechanism.

4. Apparatus according to claim 3 wherein at least one of the mandrel and die is mounted as a double acting piston mounted between forward and pressurized fluid chambers, wherein the servo mechanism comprises a pressurized fluid servo valve including a pressure vessel, an internal valve spool having a stem exiting one end of the pressure vessel, a pressurized fluid inlet port for connection to the source of pressurized fluid, first and second pressurized fluid outlet ports, the first pressurized fluid outlet port connected to the rearward pressurized fluid chamber and the second pressurized fluid outlet port connected to the forward pressurized fluid chamber, the first mechanical linkage interconnecting the first sensing means and pressure vessel and the second mechanical linkage interconnecting the second sensing means and spool stem and the first and second mechanical linkages supporting the pressure vessel for free forward and rearward movement, upon the actual gap between the mandrel and die being detected by the first and second sensing means as being larger than the predetermined gap the first and second mechanical linkages causing relative movement between the pressure vessel and the valve spool to interconnect the pressurized fluid inlet port with the first pressurized fluid outlet port to admit pressurized fluid to the rear chamber to apply force to the double acting piston to move the double acting piston toward the other of the die and mandrel to close the actual gap and establish the predetermined gap, and upon the actual gap between the mandrel and die being detected by the first and second sensing means as being smaller than the predetermined gap the first and second mechanical linkages causing relative movement between the pressure vessel and the valve spool to interconnect the pressurized fluid inlet port to the second pressurized fluid outlet port to admit pressurized fluid to the forward pressurized fluid chamber to apply force to the double acting piston to move the double acting piston away from the other of the mandrel and die to open the actual gap and establish the predetermined gap.

5. Apparatus according to claim 4 wherein the pressurized fluid inlet port is provided centrally of the pressure vessel and wherein the first and second pressurized fluid outlet ports are provided, respectively, on either side of the pressurized fluid inlet port, and wherein the spool valve is provided with a single central ridge for being positioned opposite the pressurized fluid inlet valve upon the actual gap between the die and mandrel being equal to the predetermined gap.

6. Apparatus according to claim 4 wherein the product is tubing, wherein the die is connected as the double acting piston, wherein the mandrel is provided with a centrally formed bore extending from the rear of the mandrel toward the front of the mandrel to a point in close proximity to the gap between the mandrel and the die, wherein the first sensing means comprise a sensing rod positioned in the bore for relative movement with respect to the mandrel with the front of the sensing rod connected to the front of the mandrel in close proximity to the gap and with the rear of the rod connected to the first mechanical linkage, and wherein the die includes a generally annular extrusion die and a cylindrical die stem supporting the extrusion die, the I.D. of the die stem being larger than the I.D. of the rearward portion of the extrusion die thereby providing a generally longitudinally extending annular space, and wherein the second sensing means comprise a sensing cylinder positioned in the annular space for relative movement with respect to the die stem and with the front end of the sensing cylinder connected to the extrusion die at a point in close proximity to the gap and with the rear of the sensing cylinder connected to the second mechanical linkage whereby the actual gap between the mandrel and die is detected by the control apparatus at two points in close proximity to the actual gap between the mandrel and die.

7. Apparatus according to claim 4 wherein the first and second mechanical linkages are provided, respectively, with first and second pivot points and wherein said apparatus further includes support means for said first and second pivot points which support means is not subject to stress caused by the extrusion of said product whereby said two pivot points remain fixed relative to each other.

8. Method of controlling the gap between a mandrel and an extrusion die during extrusion, comprising the steps of:

detecting that the actual gap between the mandrel and die during extrusion is larger than a predetermined gap and causing relative movement between the mandrel and die to close the actual gap and establish the predetermined gap, and detecting that the actual gap between the mandrel and die during extrusion is smaller than the predetermined gap and causing relative movement between the mandrel and die to open the actual gap and establish the predetermined gap.

* * * * *